US009248936B2

(12) United States Patent
Rayburn et al.

(10) Patent No.: US 9,248,936 B2
(45) Date of Patent: Feb. 2, 2016

(54) END CLOSURE WITH TAB GUIDANCE FEATURES

(71) Applicant: Ball Corporation, Broomfield, CO (US)

(72) Inventors: Robert M. Rayburn, Broomfield, CO (US); Kenneth D. Anderson, Golden, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 14/202,766

(22) Filed: Mar. 10, 2014

(65) Prior Publication Data

US 2014/0263328 A1 Sep. 18, 2014

Related U.S. Application Data

(60) Provisional application No. 61/792,541, filed on Mar. 15, 2013.

(51) Int. Cl.
*B65D 17/34* (2006.01)
*B65D 17/00* (2006.01)

(52) U.S. Cl.
CPC ..... *B65D 17/165* (2013.01); *B65D 2517/0014* (2013.01)

(58) Field of Classification Search
CPC ..... B65D 17/165; B65D 2517/0014
USPC ..... 220/269, 906; 413/12, 14–16
See application file for complete search history.

(56) References Cited

U.S. PATENT DOCUMENTS

| | | | | |
|---|---|---|---|---|
| 4,024,981 | A * | 5/1977 | Brown | 220/269 |
| 4,150,765 | A | 4/1979 | Mazurek | |
| 4,276,993 | A * | 7/1981 | Hasegawa | 220/269 |
| 4,289,251 | A * | 9/1981 | Maliszewski | 220/269 |
| 4,417,668 | A | 11/1983 | Stolle | |
| 4,524,879 | A * | 6/1985 | Fundom et al. | 220/273 |
| 5,011,037 | A | 4/1991 | Moen et al. | |
| 5,129,541 | A | 7/1992 | Voigt et al. | |
| 5,385,254 | A | 1/1995 | Hannon | |
| 5,653,355 | A * | 8/1997 | Tominaga et al. | 220/269 |
| 5,711,448 | A | 1/1998 | Clarke, III | |
| 5,715,964 | A | 2/1998 | Turner et al. | |
| 5,860,553 | A | 1/1999 | Schubert | |
| 6,024,239 | A | 2/2000 | Turner et al. | |
| 6,161,717 | A | 12/2000 | Forrest et al. | |
| 6,164,480 | A | 12/2000 | Heinicke et al. | |
| 6,234,336 | B1 | 5/2001 | Neiner | |

(Continued)

FOREIGN PATENT DOCUMENTS

WO WO 2012/143322 10/2012

OTHER PUBLICATIONS

International Search Report and Written Opinion for International (PCT) Patent Application No. PCT/US2014/022570, mailed Jul. 1, 2014 8 pages.

*Primary Examiner* — Fenn Mathew
*Assistant Examiner* — James N Smalley
(74) *Attorney, Agent, or Firm* — Sheridan Ross P.C.

(57) ABSTRACT

An improved end closure for food and beverage containers is provided. The end closure contains a raised bead portion for guiding and directing the opening or lifting motion of a tab portion attached to the end closure. More efficient opening features are enabled by the guided action of the tab and raised bead features.

14 Claims, 7 Drawing Sheets

(56) References Cited

U.S. PATENT DOCUMENTS 6,330,954 B1 * 12/2001 Turner et al. ..... 220/269
6,405,881 B1 6/2002 Park
6,405,889 B1 6/2002 Neiner
6,575,684 B2 6/2003 Heinicke et al.
6,715,629 B2 4/2004 Hartman et al.
6,889,862 B2 5/2005 Vaughan
6,951,293 B2 * 10/2005 Thibaut ..... 220/268
7,165,696 B2 1/2007 Neiner

* cited by examiner

END CLOSURE WITH TAB GUIDANCE FEATURES

This U.S. Non-Provisional patent application claims the benefit of priority to U.S. Provisional Patent Application 61/792,541, filed Mar. 15, 2013, the entire disclosure of which is hereby incorporated by reference in its entirety.

FIELD OF THE INVENTION

The present invention relates to end closures for two-piece beer and beverage metal containers, having a frangible tear panel and a retained-tab secured by a rivet. More specifically, the present invention relates to improved characteristics for opening the frangible tear panel of the end.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum. End closures for such containers are also typically constructed from a cutedge of thin plate of aluminum or steel, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "stay-on-tab" ends in which the tab remains attached to the end after the opening panel is opened. Throughout the use of such ends, manufacturers have sought to save the expense of the metal by downgauging the metal of the ends and the tabs. However, because ends are used for containers with pressurized contents, the score of the opening panel must have sufficient score residual to withstand such pressure, which in turn requires that the tab have a thickness of metal to provide strength to open the panel. Further, with the more recent popular use of large-open ends, additional problems arise with regard to openability of the ends. Because of the enlarged size of the opening panel (or tear panel), more stress is placed on the tab during opening of the tear panel, constraining efforts to further downgauge the tab.

Another problem with such container ends is the restriction to the material and cost savings when seeking to make the ends from a thinner metal stock (downgauging), primarily due to the fact that the traditional geometry of such ends requires one to make the ends from a larger cutedge of metal when attempting to make the end of thinner gauge metal.

As is explained in greater detail below, the present invention reduces or eliminates these problems with ecology type ends and the problems with the large-open ends.

SUMMARY OF THE INVENTION

It is an object of the present invention to provide an end closure for a container having a central panel wall with a product side and a public side. The end has a displaceable tear panel in the central panel wall at least substantially defined by a frangible score and a non-frangible hinge segment, and a tab attached to the public side of the central panel wall by a rivet, at least a nose portion of the tab extending over a portion of the tear panel.

It is further an object of the present invention to provide an end closure having a bead segment positioned under a portion of the tab nose. The bead segment has an upper surface for contact with the tab nose and is adapted to direct an opening force toward the transition zone of the score when an opening force is applied by lifting the tab from the lift end such that the nose is applied against the tear panel.

It is yet another object of the present invention to provide an end closure with a severable opening, a tab for transmitting a force to the opening, and a raised bead feature for aiding in opening operations. In one embodiment, a tab rotates about a rivet such that the nose of the tab moves downward toward the tear panel or opening area. A left side of the nose of the tab contacts a raised bead feature, the raised bead feature being adjacent to a fourth segment of the score. Upon opening, the nose of the tab can no longer continue to move directly down on to the tear panel as: (1) the tab is attached to the panel wall by the rivet; and (2) the left part of the tab nose is prevented from further downward movement by the raised bead, the tab must thus tilt until the right part of the tab nose touches the tear panel adjacent to the first segment of the score, where force is now applied to continue the opening of the score. In the left part of the tab nose, on the lower surface, there is a notch which coincides with the raised bead. When the tab contacts the raised bead, the bead enters this notch which then restricts the rotation of the tab about the rivet. In this way, the force applied to the tear panel is aligned to the area adjacent to the first segment of the score. Apart from the notch portion, the nose of the tab is of uniform thickness.

In one embodiment, a metallic end closure adapted for interconnection to a neck of a beverage container is provided, the end closure comprising a peripheral curl, a chuck wall extending inwardly from said peripheral curl, a countersink interconnected to a lower portion of said chuck wall, an inner panel wall interconnected to said countersink, a central panel interconnected to said inner panel wall, a lift tab having a nose end and a tail end, said lift tab operably interconnected to an upper surface of said central panel, said central panel comprising a frangible score line which defines a tear panel, said tear panel comprising a raised bead feature, and said raised bead feature provided below a portion of said nose end of said lift tab at least when the tab is provided in a first position. During an opening operation of said tear panel said tail end of said lift tab is raised and a portion of said nose end of said lift tab contacts said raised bead feature such that a contact between said nose end and said raised bead feature causes a rotation of said tab toward a lateral portion of the tear panel.

Other advantages and aspects of the invention will become apparent upon making reference to the specification, claims, and drawings to follow.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1:
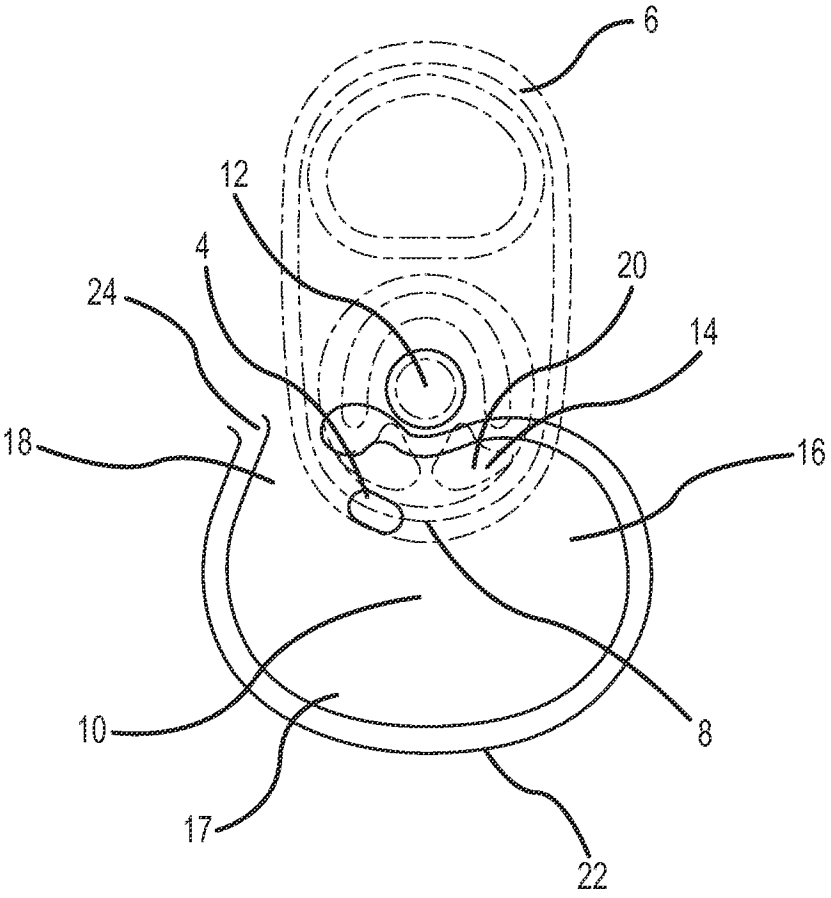
FIG. 1 is a top plan view of features of an end closure according to one embodiment of the present invention.

FIG. 1 is a top plan view of one embodiment of the present disclosure comprising a raised bead 4 for aiding in operations of a tear panel 10 of a container end closure. As shown, a tear panel 10 is provided and generally defined by a severable score line 22. The tear panel 10 is severable about the score line 22 by a lifting action applied to a tab 6 which drives a nose portion 8 of the tab 6 downwardly into the tear panel 10. The tab 6 is secured to the end panel via a rivet 12. The tear panel 10 and score line 22 generally comprise first 14, second 16, third 17, and fourth 18 tear segments. A first force-application area 20 is provided proximal the first segment 14.

A raised bead portion 4 is provided, the raised bead portion extending from and above a central panel of the end closure and provided beneath the tab 6, at least when the tab 6 is in a first position. The bead portion 4 is provided to interface with an underside of the tab nose portion 8, at least during an opening operation. Specifically, in various embodiments of the present invention, the raised bead 4 contacts a notch portion (26 of FIG. 2) of the tab nose 8 and prevents undesired rotation of the tab 6 about the rivet 12 and directs an opening force at least partially toward the first force-application area 20.

Known devices, including that disclosed in U.S. Pat. No. 6,024,239 to Turner et al., which is hereby incorporated by reference in its entirety, fail to disclosure features of the present invention including, for example, a raised bead portion that directs force away from a transition zone and/or termination feature. Turner, for example, discloses a device that directs a force toward the transition zone and thus places increased risk of rotation and stress upon features of the end closure including, for example, the tab.

Figure 2:
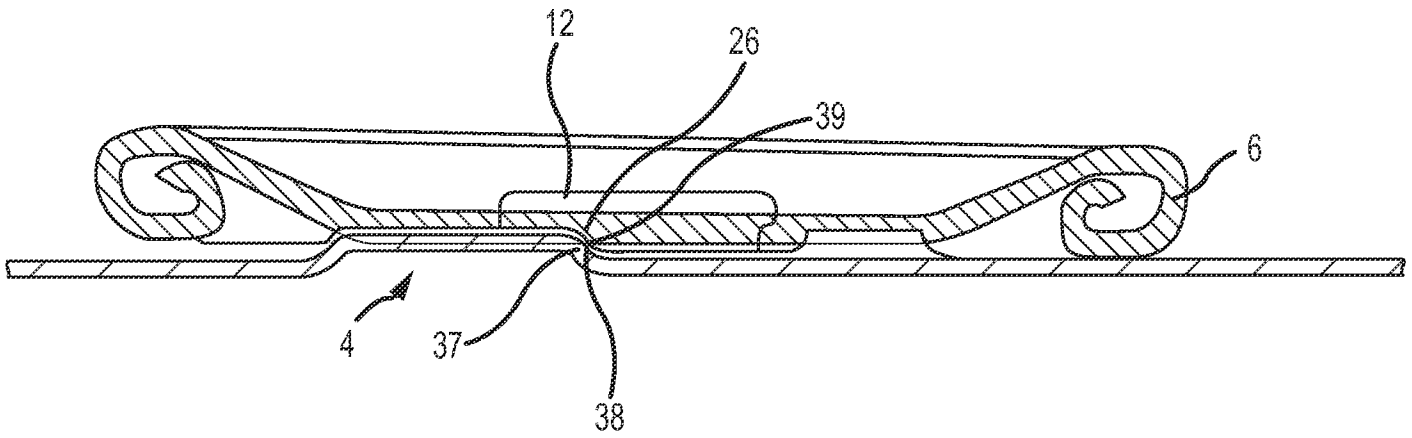
FIG. 2 is a side elevation view of features of an end closure according to one embodiment of the present invention.

FIG. 2 is a cross-sectional elevation view of an end closure according to one embodiment of the present invention. A tab 6 and raised bead portion 4 are provided on the end closure. The tab 6 comprises a contour or notch portion 26 for receiving and interacting with the raised bead 4. The notch portion 26 and raised bead 4 comprise complementary surfaces for engaging one another and preventing rotation of the tab 6 about a substantially vertical axis extending through the rivet 12. A peripheral edge 37 of the raised bead 4 provides a contact surface for a downwardly extending surface 39 provided on the tab 6. Thus, a contact area 38 is provided between the raised bead 4 and the tab 6. This contact area 38 serves to prevent undesired rotation (e.g. about a substantially vertical axis of the container) of the tab 6 during opening of the opening area. The contact area 38 further directs an opening force on the tear panel 10 toward the first segment 14, thus directing opening force toward the preferred area of force application 20.

Figures 3, 4:
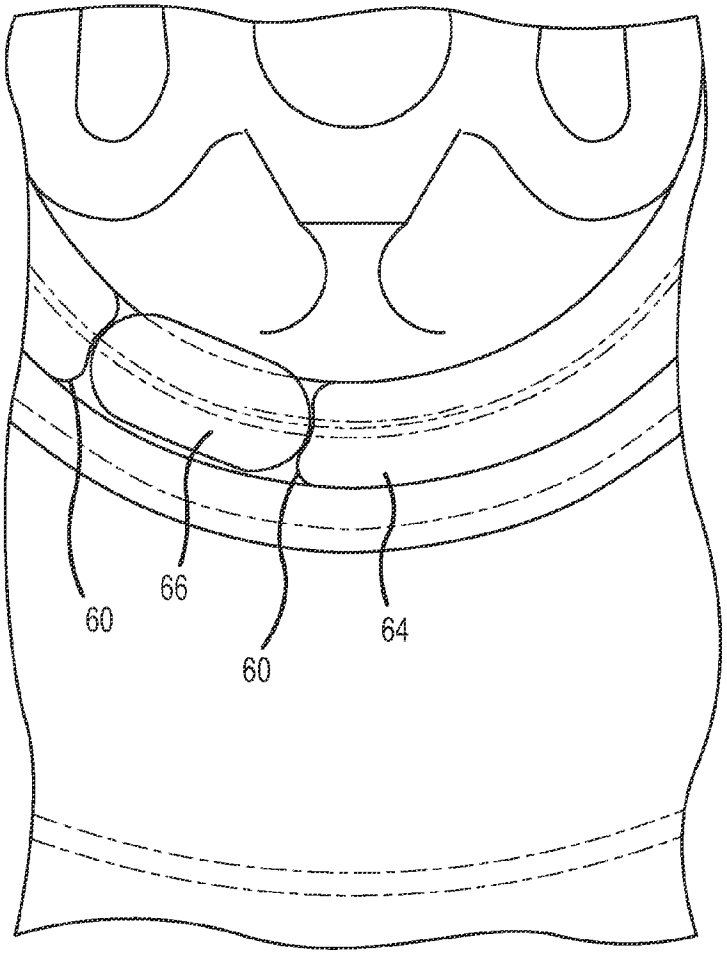
FIG. 3 is a top plan view of features of an end closure according to one embodiment of the present invention.
FIG. 4 is a detailed top plan view of features of an end closure according to one embodiment of the present invention.

FIGS. 3-4 show one embodiment of a tool for forming a portion of an end closure according to one embodiment. As shown, corresponding features for the tab 60, rivet 62, bead 66, and nose portion 64 are provided. Such inversed features are provided for illustration only. Preferably, and as shown and described herein, the bead 66 is formed in a central panel portion and comprises a raised feature. The tab, once formed, is positioned over the bead 66. The tool of FIGS. 3-4 provides for the formation and/or addition of such features.

Figure 5A:
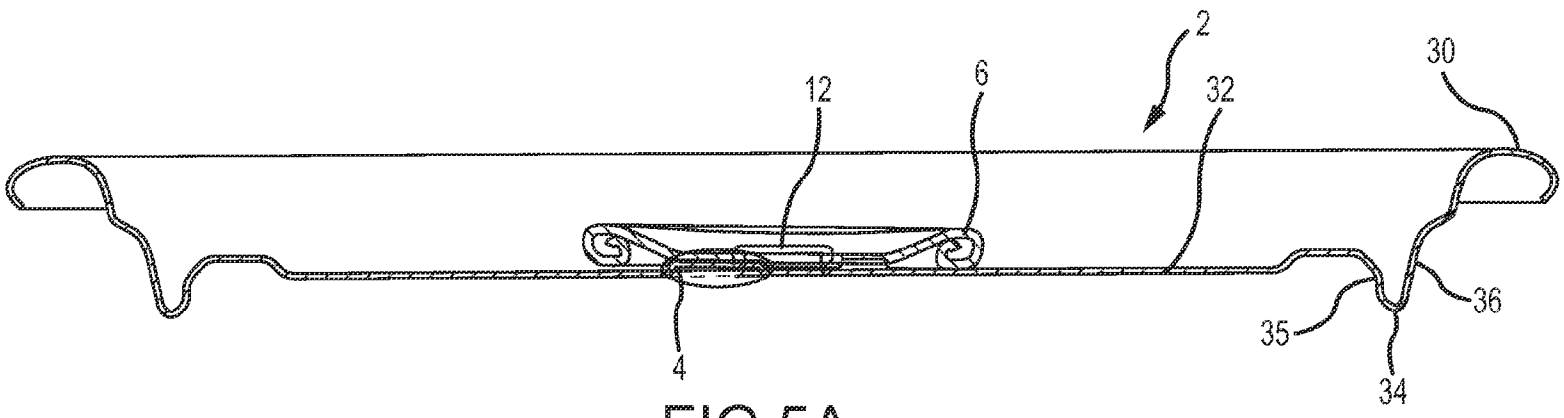
FIG. 5A is a cross-sectional side elevation view of one embodiment of the present invention.
Figure 5B:
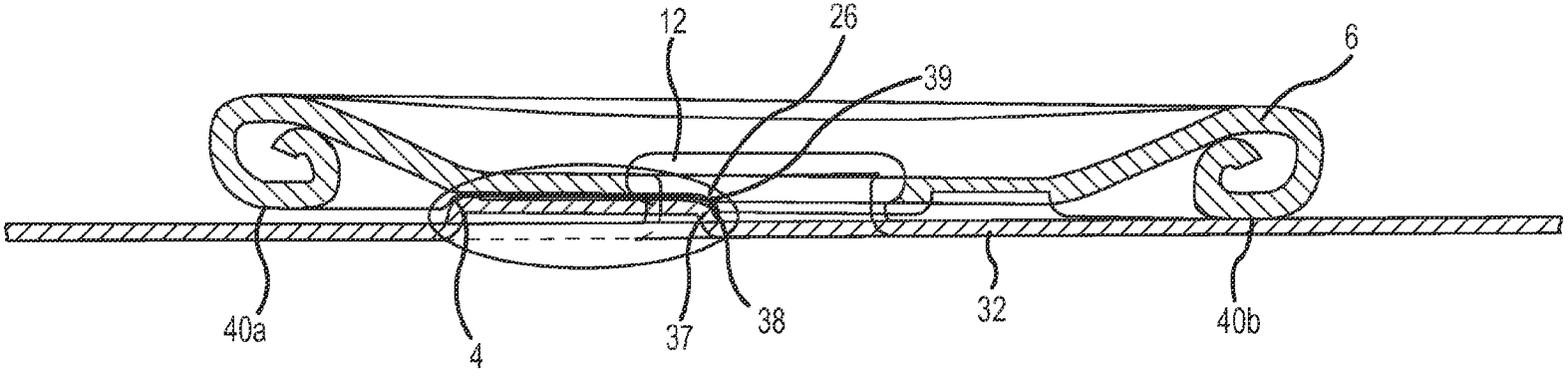
FIG. 5B is a detailed view of FIG. 5A.

FIGS. 5A-5B show cross-sectional elevation views of one embodiment of the present invention. An end closure 2 is provided, the end closure suitable for interconnection to a container body via peripheral cover hook portion 30. Peripheral cover hook portion 30 is interconnected to a central panel 32 via one or more features, including but not limited to a countersink 34, inner panel wall 35 and downwardly extending chuck wall 36. The central panel 32 comprises a rivet 12 upon which a tab 6 is mounted. The central panel 32 further comprises a tear panel (10 of FIG. 1) defined by a score line. Provided within the tear panel 10 is a raised bead feature 4 which extends above a remainder of the surface of the central panel 10 and opening area, the central panel 10 and opening area being provided in substantially the same plane and comprising substantially the same height. The raised bead 4 is provided beneath and in close proximity to or, in certain embodiments, in contact with the tab 6. In certain embodiments, the tab 6 comprises a notch feature 26 within which the raised bead 4 is received. A peripheral edge 37 of the raised bead 4 provides a contact surface for a downwardly extending surface 39 of the tab 6. Thus, a contact area 38 is provided between the raised bead 4 and the tab 6. This contact area 38 serves to prevent undesired rotation of the tab 6 during opening of the opening area and direct an opening force on the tear panel 10 toward the first segment 14, thus directing opening force toward the preferred area of force application 20.

As shown in FIGS. 5A-5B, a first end 40*a* of the tab 6 is provided at a height above the central panel 32 and a second end 40*b* of the tab 6 is provided substantially flush or in contact with the central panel 32, at least when the tab 6 is provided in a first position. As used herein, the term "first position" generally refers to a position of the tab 6 and tear panel 10 when the container is closed, such as when the container is filled, pressurized, sealed and ready for opening. The offset provided at the one side 40*a* further helps to assure that force is applied to the preferred area of the panel 10.

In various embodiments, the raised bead feature 4 comprises an upstanding feature that extends above (i.e. toward the public side) the central panel. In certain embodiments, a maximum height of the raised bead 4 extends above the central panel between approximately 0.005 inches and 0.020 inches. In preferred embodiments, a maximum height of the raised bead 4 extends above the central panel between approximately 0.010 inches and 0.015 inches. However, the present invention is not limited to raised features which extend a particular height. Indeed, various alternatives are contemplated in regards to the dimensions of the bead.

In order to prevent clockwise rotation (i.e. with respect to FIG. 1) of the tab 6, the raised bead portion 4 extends radially outward beyond a lowermost portion of the tab 6 proximal the first side 40*a*. The contact area 38 is provided at an opposing side of the bead, proximal the rivet 12, such that the contact area 38 prevents such clockwise rotation. In various embodiments, counter-clockwise rotation about the rivet is enabled or not prevented. In certain embodiments, tab rotation about the rivet 6 is substantially prevented.

Figure 6A:
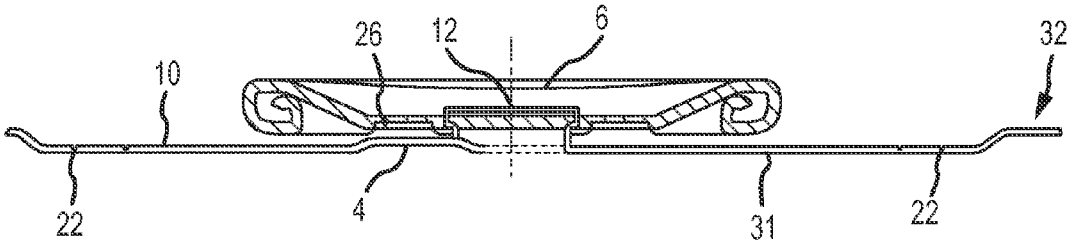
FIG. 6A is a cross-sectional side elevation view of one embodiment of the present invention along line A-A of FIG. 8.
Figure 8A:
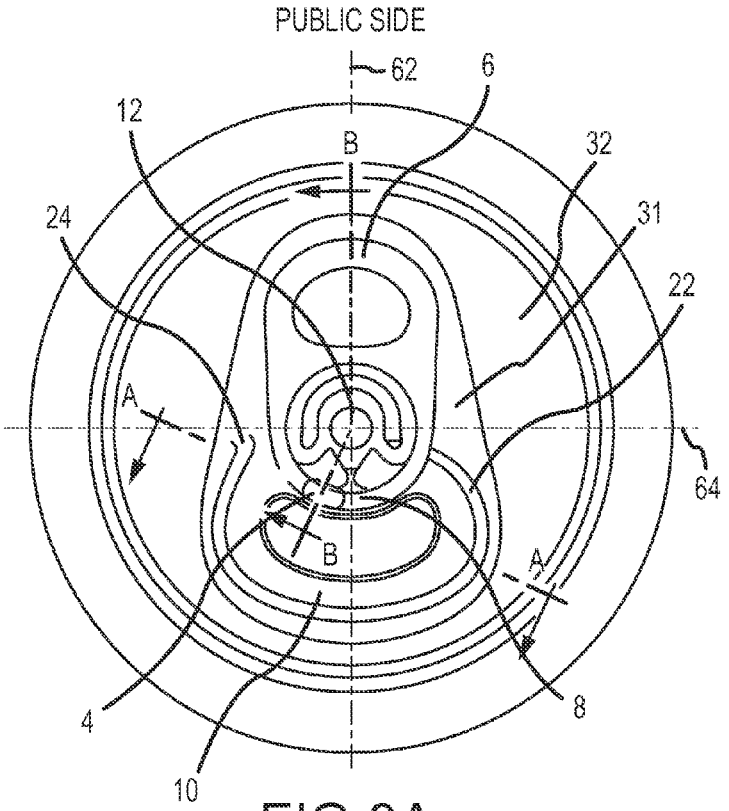
FIG. 8A is a top plan view of an end closure according to one embodiment of the present invention.

Referring now to FIG. 6A, one embodiment of an end closure is provided and depicted along line A-A of FIG. 8A. As shown, a central panel 32 is provided upon which a tab 6 is secured on a rivet 12. An upstanding bead 4 is provided, and shown as being forward of the rivet 12 in FIG. 6A. In the depicted embodiment, the bead 4 comprises a flat-topped or plateau-shaped structure suitable for operating as shown and described herein. For reference, the score line 22 is shown, the score line 22 residing within a debossed area of the central panel 32. The tab comprises a notch 26 or recess for interacting and/or receiving the bead 4. The score line 22 generally defines a tear panel 10 upon which the bead 4 resides. As shown and described herein, communication between the bead 4 and the tab 6 provides for an asymmetric rotation of the tab, and applies a directed force to the tear panel 10 during opening operations.

Figure 6B:
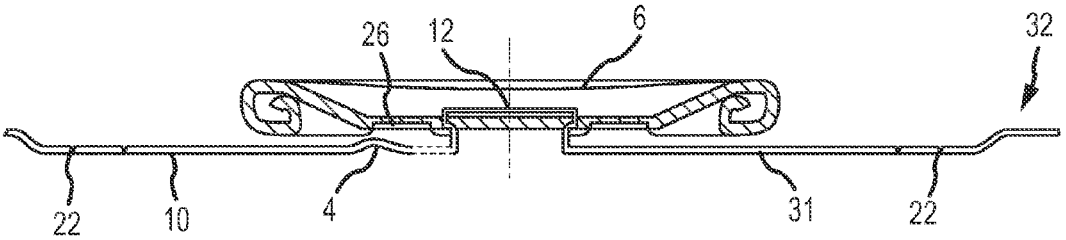
FIG. 6B is a cross-sectional side elevation view of one embodiment of the present invention along line A-A of FIG. 8.

An alternative embodiment of a closure is provided in FIG. 6B, wherein the raised bead 4 comprises a tapered or pointed feature. FIG. 6B provides similar structure to that of FIG. 6A and is taken at line A-A of FIG. 8A. FIG. 6B, however, provides a raised bead 4 of different cross-section, wherein the cross-section of the raised bead 4 of FIG. 6B is an upstanding peak rather than a plateau. It will be recognized that upstanding or raised bead 4 features of the present disclosure are not limited to any particular shape or configuration. Indeed, various shapes, sizes, and corresponding notches in the tab nose are contemplated.

Figure 7A:
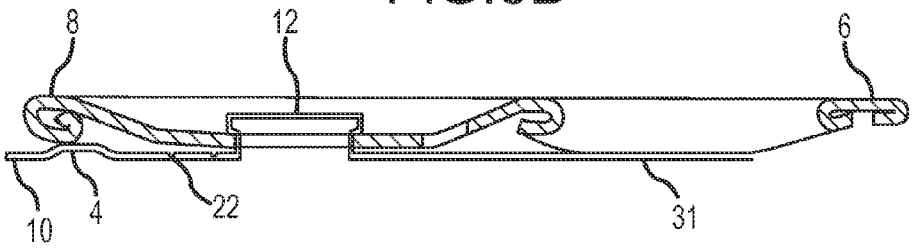
FIG. 7A is a cross-sectional side elevation view of one embodiment of the present invention along line B-B of FIG. 8A.
Figure 7B:
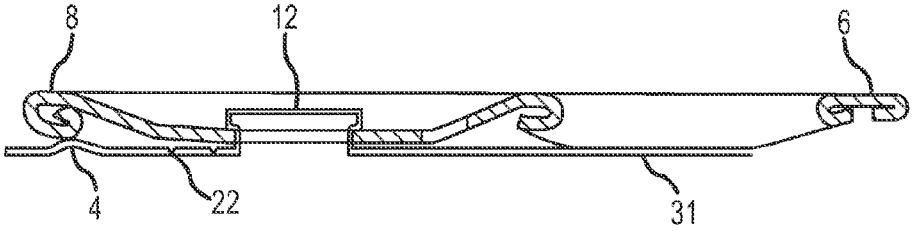
FIG. 7B is a cross-sectional side elevation view of one embodiment of the present invention along line B-B of FIG. 8A.

FIG. 7A provides a cross-sectional view of one embodiment of the present disclosure taken along line B-B of FIG. 8A. A nose portion 8 of the tab 6 is positioned to the left, with the user operable portion or tail of the tab 6 provided at the opposing right end. The raised bead 4 is provided beneath the nose portion 8 and comprises a flat feature, but may comprise any number of alternative arrangements as discussed. The cross-section of FIG. 7A is provided approximately through the center of the bead 4 and through the center of the notch 26 such that the tab 6 is being depicted as residing on top of the bead 4. The debossed area 31 is shown as extending underneath the tab 6. FIG. 7B depicts an alternative embodiment of an end closure with a raised bead 4, also taken about line B-B of FIG. 8A. The bead 4 of FIG. 7B comprises a peak or tapered feature for interaction with the tab 6.

Figure 8B:
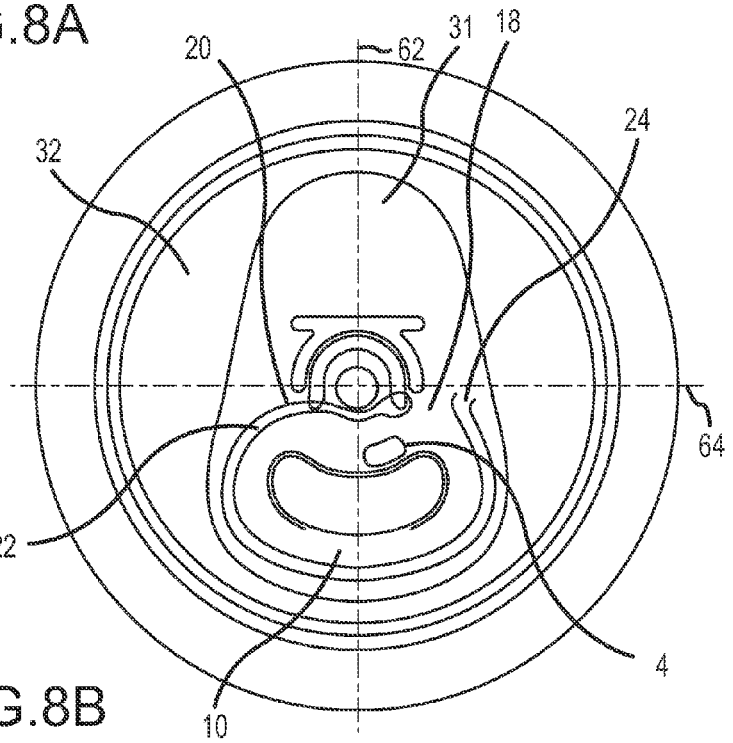
FIG. 8B is a bottom plan view of an end closure according to one embodiment of the present invention.

FIGS. 8A and 8B depict top and bottom plan views of one embodiment of the present invention, respectively. Various features as shown and described herein are provided. Although the bead portion 4 is shown in FIG. 8A, it will be understood that the bead 4 is provided beneath at least a portion of the tab 6.

FIGS. 8A and 8B further depict a longitudinal axis 62 of the closure and a lateral axis 64 of the closure. Although certain features of the closure (e.g. the raised bead 4) render the closure somewhat asymmetrical, the closure is generally divided into equally sized lateral portions on either side of the longitudinal axis as shown in plan view. The longitudinal axis 62 runs through the center of the closure, tab 6, rivet 12 and tear panel 10. The lateral axis 64 is provided substantially perpendicular to the longitudinal axis 62, and similarly divides the closure into segments.

Figure 9:
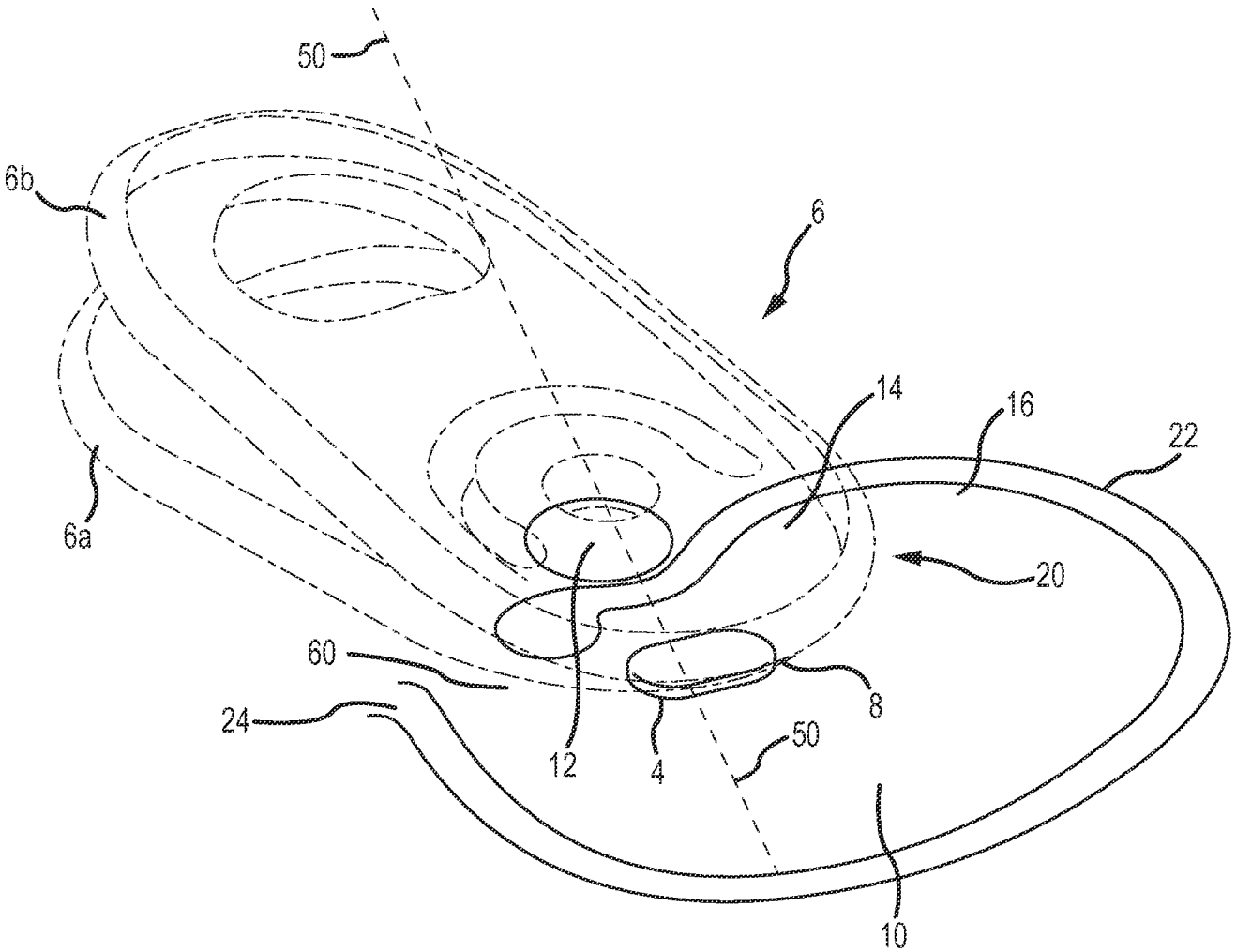
FIG. 9 is a perspective view of features of an end closure according to one embodiment of the present invention.

FIG. 9 depicts various features of one embodiment of the present invention and illustrates an opening sequence of the same. As shown, a tab 6 is provided in a first closed position 6*a* and a second partially-raised or partially-open position 6*b*. A bead 4 is shown as being visible through the nose 8 of the tab 6. Upon raising the tab 6 to the raised position 6*b*, the nose portion will apply force downwardly upon the tear panel 10, forcing open the tear panel. In a first position 6*a* and an open position 6*b*, the bead 4 prevents rotation about the rivet 12 and vertical axis extending therethrough. An additional axis of rotation 50 is depicted, about which the tab 6 is permitted to rotate, but only in one direction and toward first opening segment 14 and preferred area of force transmission 20 of the tear panel 10. The axis 50 represents an axis extending longitudinally along a central portion of the tab 6. The tab 6 is allowed to roll off center or pivot transversely about the axis 50, and direct force primarily upon segment 14, thus inducing a severing action upon a score line at an end of the score line opposing the termination feature 24. Rotation about axis 50 is provided at least in part due to features discussed herein, namely the sizing and position of the raised bead 4, peripheral edge 37 and interface 38.

FIG. 9 further depicts a non-frangible hinge portion 60 of the closure. The hinge portion 90 comprises an area of the tear panel 10 proximal the rivet 12 about which the tear panel 10 hinges open. Opposite rotation is substantially prevented by the extension of the bead 4 beyond the tab portion 6 on the one side.

In various embodiments, it is contemplated that the tab 6 will rotate or "tilt" about axis 50 by at least approximately 10 degrees. In preferred embodiments, it is contemplated that the tab 6 rotates about axis 50 by between approximately 15 and 25 degrees during an opening operation.

One of skill in the art will recognize that opening forces required to sever the tear panel 10 are reduces by focusing a pressure on or toward first opening portion 14, as opposed to directing force from the nose of the tab 6 symmetrically about a longitudinal axis running through the center of the tab 6. As shown in FIG. 9, the depicted rotation of the tab 6 about axis 50 induces the beginning of a score fracture propagation on a first side of the axis 50 (i.e. proximal first opening portion 14). A score fracture will then propagate clockwise (as shown in FIG. 9) along the score line 22 and extend toward score termination feature 24, which comprises an outward curvature diverting from the general path of the score line 22. The raised bead 4 provided on the tear panel 10 and in communication with the tab during an opening operation thus biases the tab in a rotational manner as depicted and facilitates the opening process described above.

What is claimed is:

1. A metallic end closure adapted for interconnection to a neck of a beverage container, comprising:

a peripheral curl;

a chuck wall extending inwardly from said peripheral curl;

a countersink interconnected to a lower portion of said chuck wall;

an inner panel wall interconnected to said countersink;

a central panel interconnected to said inner panel wall, said central panel comprising a longitudinal axis and a lateral axis, said axes being substantially perpendicular;

a tab having a nose end and a tail end, said tab secured to an upper surface of said central panel by a rivet;

said longitudinal axis and said lateral axis extending along the end closure and intersecting at said rivet;

said central panel comprising a frangible score line which defines a tear panel;

said tear panel comprising a raised bead feature radially offset from said longitudinal axis and extending above a public side of said tear panel, said raised bead feature provided below a portion of said nose end of said tab at least when the tab is provided in a first position;

a recess formed in the nose end of said tab, said recess provided in force-transmitting contact with said raised bead feature; and wherein during an opening operation of said tear panel said tail end of said tab is raised and a portion of said nose end of said tab contacts said raised bead feature, wherein said raised bead feature causes a rotation of said tab toward a lateral portion of the tear panel to initiate propagation of said frangible score line in a predetermined location.

2. The metallic end closure of claim 1, wherein the raised bead feature is provided on a first side of the longitudinal axis.

3. The metallic end closure of claim 2, wherein a contact between the raised bead feature and the tab causes a rotation of the tab toward a second side of the longitudinal axis.

4. The metallic end closure of claim 3, wherein the propagation of the score defining the tear panel is initiated on the second side of the longitudinal axis.

5. The metallic end closure of claim 1, wherein the end closure comprises a vertical axis provided perpendicular to said longitudinal and said lateral axes, and wherein a contact between the raised bead and the tab prevents rotation of said tab about said vertical axis.

6. A metallic end closure adapted for interconnection to a neck of a beverage container, comprising:

a peripheral curl surrounding a central panel;

a tab positioned along a longitudinal axis of the central panel, said longitudinal axis bisecting said central panel into a first lateral portion and a second lateral portion;

said tab having a nose end and a tail end, said tab secured to said central panel by a rivet;

said central panel comprising a frangible score line which at least partially defines a tear panel;

said tear panel comprising a raised bead feature disposed beneath said nose end of said tab at least when the tab is provided in a first position, said raised bead feature radially offset with respect to said longitudinal axis and extending above a public side of the tear panel;

the tab comprising at least one of a notch and a recess formed in the nose portion of the tab and provided in force-transmitting contact with said raised bead feature;

wherein in response to a user-applied force to lift said tail end of said tab, said tab rotates in a first rotational direction such that said nose end of said tab provides a force to said raised bead feature and said tear panel; and wherein said force provides a second rotation of said tab, said second rotation comprising a rotation of the tab toward the second lateral portion of said tab.

7. The metallic end closure of claim 6, wherein the first rotational direction comprises an axis of rotation passing laterally through a mid-point of the rivet.

8. The metallic end closure of claim 6, wherein the second rotational direction comprises an axis of rotation passing longitudinally through the tab.

9. The metallic end closure of claim 6, wherein said raised bead feature is provided in said first lateral portion of said tab.

10. The metallic end closure of claim 6, wherein said longitudinal axis bisects said rivet and said tab.

11. The metallic end closure of claim 6, wherein a contact between the raised bead and the tab prevents rotation of said tab about a substantially vertical axis extending through the rivet.

12. A metallic end closure adapted for interconnection to a neck of a beverage container, comprising:

a central panel comprising a frangible score line and a hinge portion, the central panel and the hinge portion defining a tear panel of a primary opening;

a tab positioned on the central panel, said tab having a nose end and a tail end, said nose end comprising a recess and said tab secured to said central panel by a rivet;

said tear panel comprising a raised bead feature extending above a public side of the end closure and disposed beneath at least a portion of said recess of said nose end of said tab at least when the tab is provided in a first position;

a longitudinal axis and a lateral axis extending along the end closure, said axes being substantially perpendicular to one another and intersecting proximal a center of the end closure;

wherein said raised bead feature is radially offset from at least one of said longitudinal axis and said lateral axis;

wherein in response to a user-applied force to lift said tail end of said tab, said tab is rotatable in a first rotational direction such that said nose end of said tab provides a force upon an upper portion of said raised bead feature and said tear panel; and wherein said force results in a second rotation of said tab, said second rotation comprising a rotation of the tab toward a lateral portion of the central panel and away from said raised bead feature.

13. The metallic end closure of claim 12, wherein a first opening area of the tear panel is provided on an opposing side of the longitudinal axis from the raised bead feature.

14. The metallic end closure of claim 12, wherein a contact between the raised bead and the tab prevents rotation of said tab about a substantially vertical axis when the tab and end closure are provided in a closed position.

* * * * *